US006820932B2

(12) United States Patent
Misthos et al.

(10) Patent No.: US 6,820,932 B2
(45) Date of Patent: Nov. 23, 2004

(54) COMPUTER BENCH

(75) Inventors: Krisann Misthos, Morristown, NJ (US); Chris N. Misthos, Morristown, NJ (US); Vincent Foullois, Randolph, NJ (US)

(73) Assignee: KMCOR LLC, Florham Park, NJ (US)

( * ) Notice: Subject to any disclaimer, the term of this patent is extended or adjusted under 35 U.S.C. 154(b) by 0 days.

(21) Appl. No.: 10/010,991

(22) Filed: Dec. 6, 2001

(65) Prior Publication Data

US 2003/0107249 A1 Jun. 12, 2003

(51) Int. Cl.[7] ..... A47C 15/00

(52) U.S. Cl. ..... 297/232; 297/118; 297/335; 297/353; 297/3; 297/1

(58) Field of Search ..... 297/232, 284.1, 297/118, 1, 3, 397, 353, 423.2, 423.5, 452.58

(56) References Cited

U.S. PATENT DOCUMENTS

| | | | | | |
|---|---|---|---|---|---|
| 2,623,574 | A | * | 12/1952 | Damsch | 297/111 |
| 4,053,129 | A | * | 10/1977 | Graff | 248/188.7 |
| 4,114,949 | A | | 9/1978 | Benoit | |
| 4,470,630 | A | * | 9/1984 | Shields | 297/118 |
| 4,518,203 | A | * | 5/1985 | White | 297/452.16 |
| 4,718,717 | A | | 1/1988 | Cruz | |
| 4,804,224 | A | | 2/1989 | Stapf | |
| 4,848,843 | A | | 7/1989 | Gibbs | |
| 5,312,161 | A | * | 5/1994 | Mars | 297/423.2 |
| 5,431,479 | A | | 7/1995 | Leib | |
| 5,538,323 | A | * | 7/1996 | Henkel | 297/397 |
| 5,553,551 | A | | 9/1996 | Crombie | |
| 5,558,309 | A | | 9/1996 | Marechal | |
| 5,560,056 | A | * | 10/1996 | Tai | 5/120 |
| 5,570,928 | A | | 11/1996 | Staunton et al. | |
| 5,671,975 | A | | 9/1997 | Müller | |
| 5,882,069 | A | | 3/1999 | Gunnett et al. | |
| 5,890,761 | A | * | 4/1999 | Miller | 297/232 |
| 6,109,686 | A | | 8/2000 | Fox | |
| 6,145,931 | A | * | 11/2000 | Subotic | 297/423.2 |

* cited by examiner

*Primary Examiner*—Peter M. Cuomo
*Assistant Examiner*—Erika Garrett
(74) *Attorney, Agent, or Firm*—Jeanne P. Lukasavage

(57) ABSTRACT

A bench is provided for use by at least two persons of similar or differing heights. The bench includes a seat, a back, pivotal members and a support. The pivotal members are held in a substantially vertical position adjacent to the back by a release mechanism. Unlocking the release mechanism results in the pivotal member pivoting to a substantially horizontal position adjacent to the seat. The pivotal member may be locked in this position by a locking mechanism. In addition, in one embodiment of the invention, the back may be horizontally displaced towards the front of the seat, when the pivotal member is in the substantially horizontal position. Thus, the bench may accommodate two persons simultaneously, such as an adult and a child.

7 Claims, 4 Drawing Sheets

COMPUTER BENCH

This invention generally relates to benches and more specifically relates to benches capable of accommodating at least two persons of similar or differing heights at a single workstation.

BACKGROUND OF THE INVENTION

It is well known that chairs for use with a workstation or desk, commonly known as office chairs or computer chairs, are typically built to accommodate a single person working at the desk or working on a computer at the desk. Such chairs often have wheels to make them mobile so that a person may sit as close to the desk as desired. The common office chair further typically comprises arm rests. In addition, the common computer chair is usually height adjustable, so that different persons may use the chair at a comfortable height.

Currently available office chairs are typically built to the specifications for accommodating an adult. Since these chairs are commonly used in a home office setting, often times a child wishes to use the chair to access a computer on a desk or at a workstation. Thus, a child wishing to use the chair for access to a computer typically has to sit on pillows or other means for increasing the height of the seat portion of the chair, even when the chair is adjusted to its greatest height. This proves to be an inefficient and often dangerous method for allowing a child to use a computer at an adult-sized desk, since pillows or commonly used telephone books are unstable, especially when the chair also includes wheels.

Moreover, often times in a home setting, more than one person may wish to use a single workstation in order to view a computer on a desk, since it is common for a household to only have a single computer. In addition, a classroom may have a limited number of computers for smaller children. This results in two or more children working together at a single computer or a child working with an adult such as a teacher. Thus, two or more persons often having substantially different heights may need to sit in close proximity to view a single computer screen at a single workstation. The currently available office chairs do not accommodate more than one person at a single time. Thus, if more than one person wishes to view a single computer, a second chair is necessary.

A second chair is undesirable because it occupies an excessive amount of space. Moreover, utilizing two chairs at a single workstation does not allow for optimum viewing of the computer screen simultaneously by both persons due to the awkwardness or bulk associated with two separate chairs. Moreover, even if a common type of bench is used to accommodate two persons, a child will still need to be situated on pillows or other items to be positioned at the proper height which is dangerous due to its instability.

SUMMARY OF THE INVENTION

In accordance with one aspect of the invention, a bench is provided that is capable of accommodating at least two persons of similar or differing heights. The bench includes a seat, a back, pivotal members corresponding to each seating position, and a support for supporting the bench. The pivotal members pivot between a horizontal position and vertical position. A pair of attachment mechanisms may be provided at each seating position for maintaining the corresponding pivotal member in a vertical position. Uncoupling the pair allows the corresponding pivotal member to pivot to a horizontal position. The invention further contemplates the use of adjustable foot rests. The bench may further include flip members which may be adjusted to comfortably support the back of a child or shorter person.

In accordance with another aspect of the invention a bench is provided that is capable of accommodating at least two persons. The bench includes a seat with two seating positions and at least two backs. The backs are horizontally adjustable. Pivotal members are adjacent to the backs and pivot to a horizontal position adjacent to the seat. Pairs of attachment mechanisms are provided for locking the pivotal members to the back and allowing the pivotal members to pivot when the pair is uncoupled. The seat has a support.

The bench according to the present invention may accommodate more than one person at a time. Moreover, the invention allows for persons of differing heights to be seated simultaneously on the bench at the appropriate height in order to reach a desk or a computer on a desk. Thus, it is not necessary to use two chairs to accomplish this goal. Moreover, the bench easily and neatly accommodates a shorter person or a child without the need for additional support in the form of pillows or a phone book to place the person at the proper height for viewing a desktop computer.

DETAILED DESCRIPTION

Figure 1:
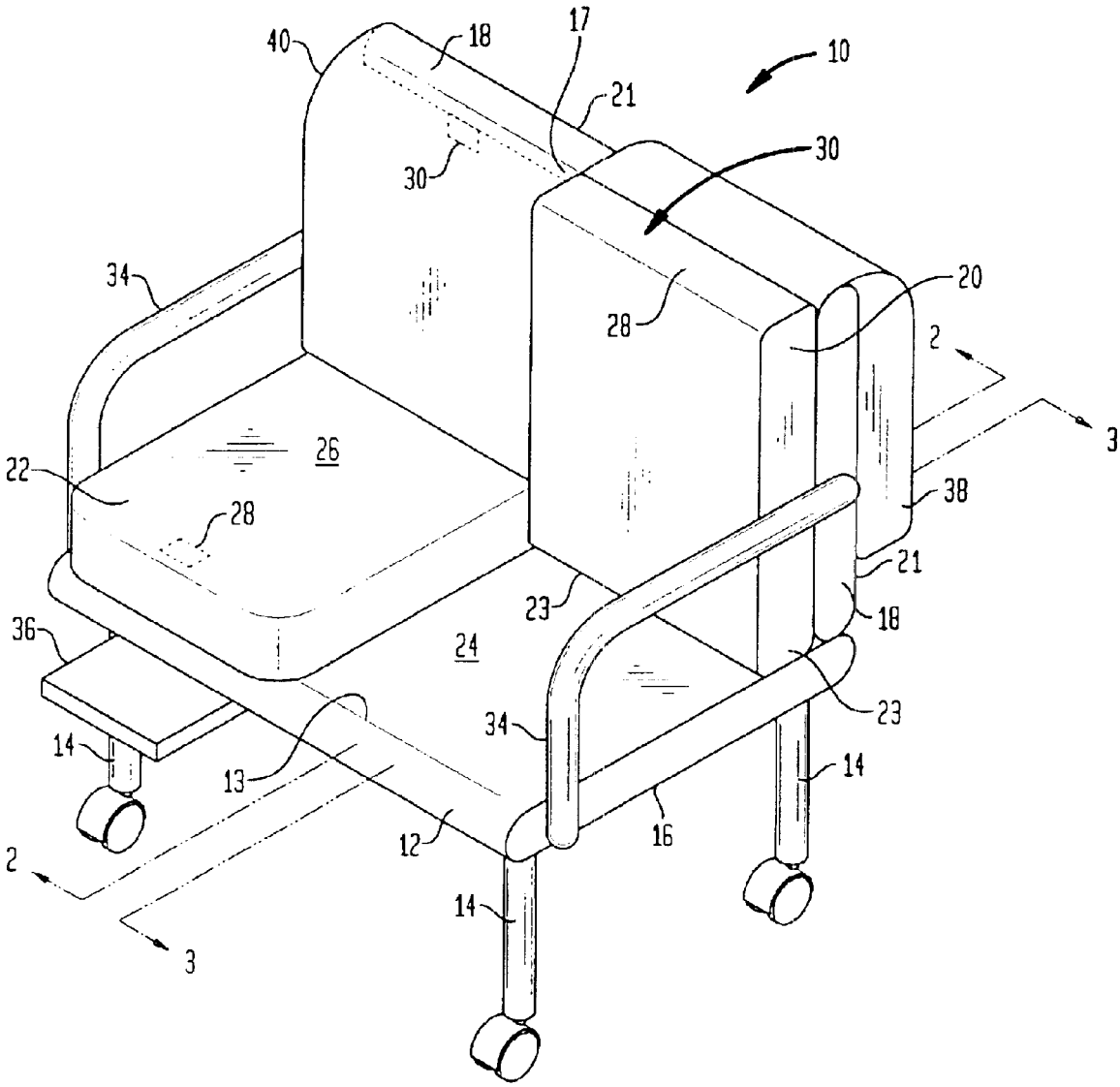
FIG. 1 is a perspective view of a bench according to one embodiment of the present invention.
Figure 2:
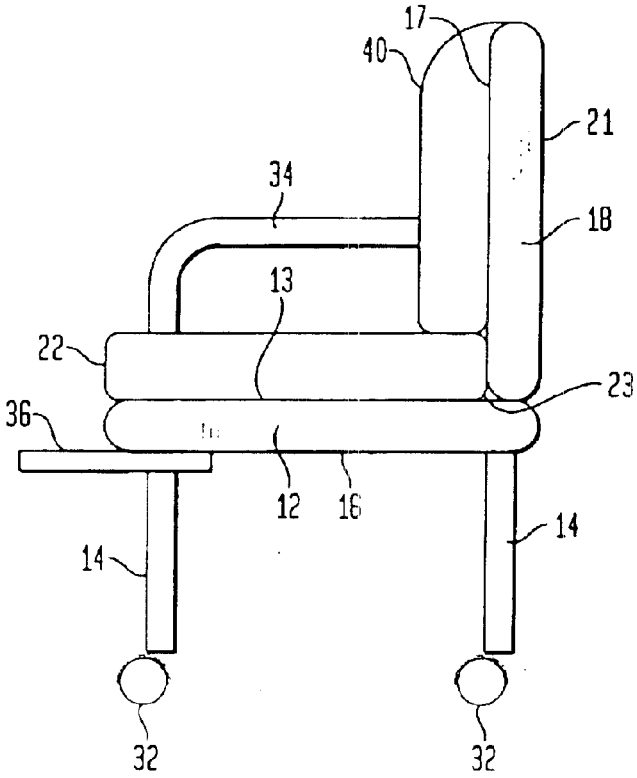
FIG. 2 is a sectional view of the bench taken along line 2—2 in FIG. 1.
Figure 3:
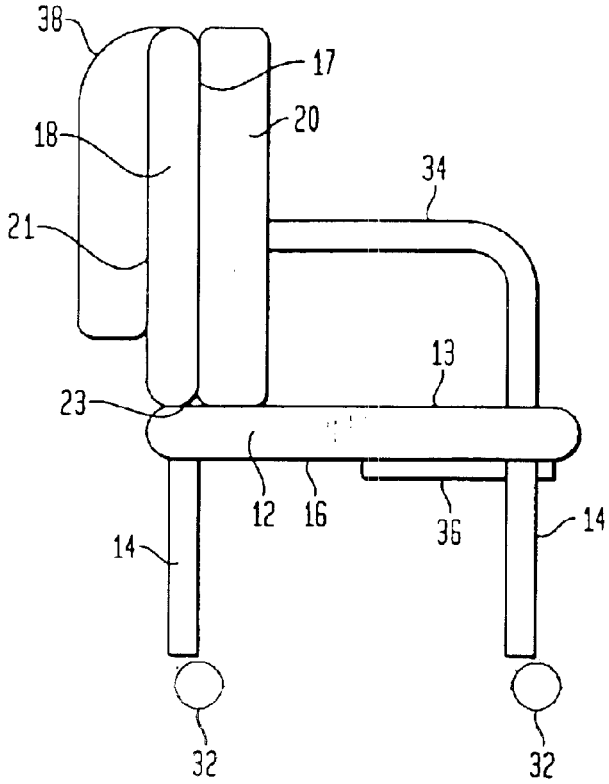
FIG. 3 is a sectional view of the bench taken along line 3—3 in FIG. 1.

Referring to FIGS. 1–3, a bench 10 capable of accommodating at least two persons of similar or differing heights working at a single workstation such as a desk having a computer terminal thereon is shown. The bench 10 comprises a seat 12 extending substantially horizontally. The seat 12 is supported by support members 14. In a preferred embodiment, the support members 14 comprise a plurality of legs attached to and extending from an underside 16 of the seat 12. The support members 14 may further include wheels 32 at an end remote from the seat 12 to facilitate movement of the bench 10 to different locations. Of course, the present invention also contemplates the use of other types of support members. For example, only two legs extending along opposite sides of the seat 12 may be utilized, or the legs may extend from other points on the underside of the seat.

The bench 10 further comprises a back 18 attached to the seat 12. The back 18 extends substantially vertically from the seat 12. The back 18 is substantially the same length as the seat 12. First and second pivotal members 20, 22 are also attached to the seat 12. The first pivotal member 20 corresponds to a first seating position 24 and the second pivotal member 22 corresponds to a second seating position 26 of the bench 10. Thus, the bench 10 can accommodate two persons at a time, one person at each seating position. Of course, the present invention contemplates a bench that may be used by more than two people. Thus, a bench to accommodate three persons would have three seating positions with three corresponding pivotal members attached to the back member and so on.

The pivotal members 20, 22 are attached to the seat 12 at junction 23 via a shared piece of material. The material is thin at the junction 23 to allow the pivotal members 20, 22 to pivot between a substantially horizontal position adjacent to a top side 13 of the seat 12 and a substantially vertical position adjacent to a front side or first side 17 of the back 18. A first attachment mechanism 28 is located on each of the pivotal members 20, 22 and a second attachment mechanism 30 is located on the first side 17 of the back 18 at each seating position. When one of the pivotal members 20, 22 is in the substantially vertical position the first and second attachment mechanisms 28, 30 are coupled. Therefore, the pivotal member maintains the vertical position. Since FIG. 1 illustrates pivotal member 20 in the vertical position, the first and second attachment mechanisms 28, 30 at seating position 24 are coupled. The attachment mechanisms may be, for example, a Velcro system or a hook and latch system. When the first and second attachment mechanisms are uncoupled, as at second seating position 26, the pivotal member 26 pivots to the substantially horizontal position adjacent to the top side 13 of the seat. As shown in the figures, the first seating position 24 has the pivotal member 20 in the substantially vertical position and the second seating position ahs the pivotal member 22 in the substantially horizontal position.

The bench further includes arm rests 34 located at either end of the seat 12. An additional arm rest (not shown) may be located between each seating position. The arm rests may possess work areas (not shown) attached thereto to provide space for a keyboard, mouse or the like.

The bench 10 further comprises first and second flip members 38, 40 attached to a top of the back 18. The first flip member 38 is substantially vertical and positioned adjacent to a back side or second side 21 of the back 18, opposite the pivotal member 20. The second flip member 40 is substantially vertical and positioned adjacent to the front side 17 of the back 18. Thus, the flip members 38, 40 may be rotated about the top of the back 18 to change between a position adjacent to a first side 17 of the back 18 and a position adjacent to a second side 21 of the back 18.

The bench 10 further includes foot rests 36 corresponding to each seating position. The foot rests 36 are slidably mounted to the underside of the seat 16.

In operation, the bench 10 can be modified to accommodate two children; two adults or one child and one adult. As shown in FIGS. 1–3, the bench 10 has been modified to accommodate an adult at the first seating position 24 and a child at a second seating position 26. The first pivotal member 20 is in the substantially vertical position adjacent to the first side 17 of the back 18. The first and second attachment mechanisms 28, 30 are coupled to secure the pivotal member 20 in the vertical position. The first flip member 38 rests adjacent to the second side 21 of the back 18. At the second seating position 26, the first and second attachment mechanisms 28, 30 have been uncoupled to allow the second pivotal member 22 to pivot about the junction 23 to the substantially horizontal position adjacent to the top side 13 of the seat 12. The second flip member 40 is then rotated about the top of the back 18 to be positioned adjacent to the first side 17 of the back 18. The corresponding foot rest 36 may then be slid out. Thus, the height of the seating area of the second seating position has been increased to afford a child or shorter person the ability to be comfortably seated at an adult-sized desk next to an adult in the first seating position. Moreover, the second flip member 40 provides the child with adequate back support and foot rest 36 provides an area for the child to place his or her feet. Therefore, a child or shorter person may be seated simultaneously next to an adult at an appropriate height so that the child may easily view a computer screen, without the need for a second chair and pillows to increase the height of the second chair.

Figure 4:
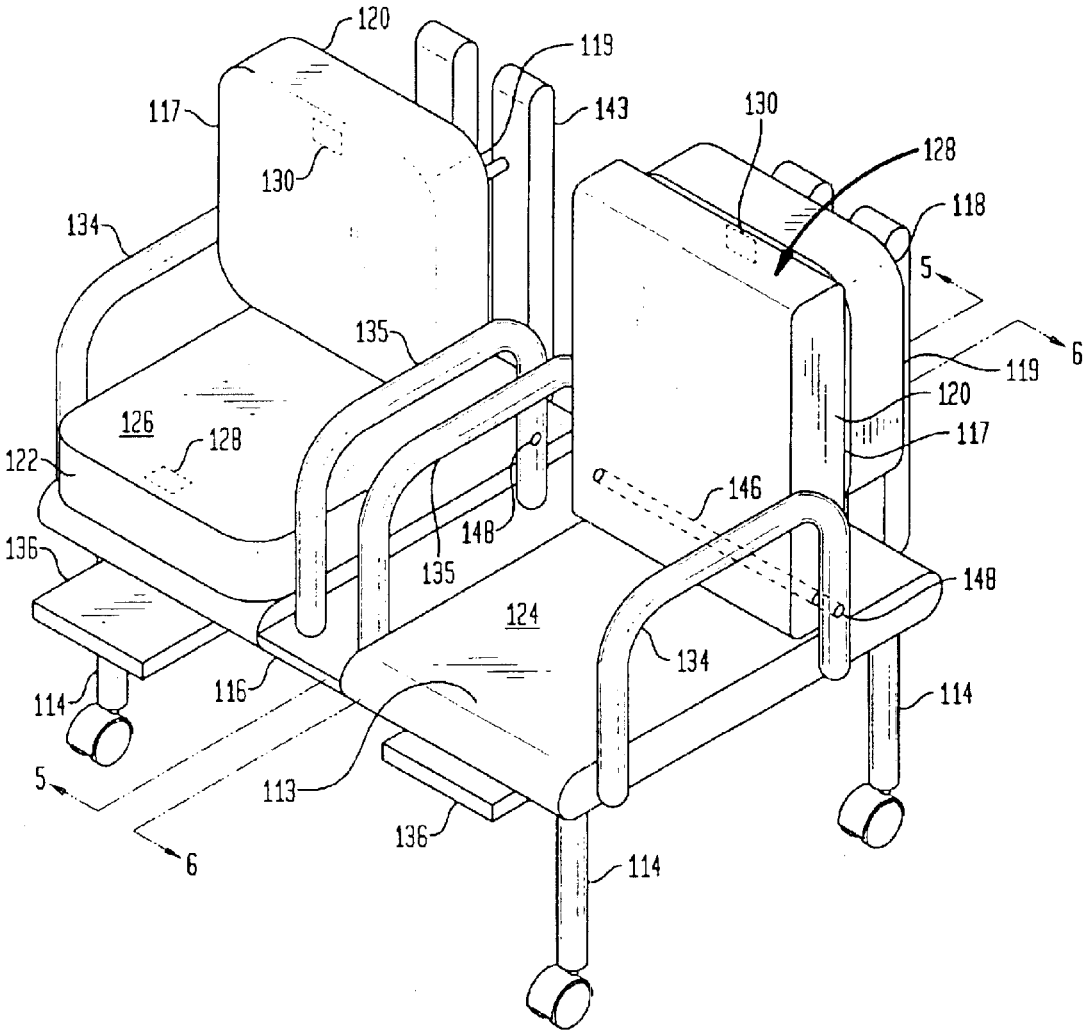
FIG. 4 is a perspective view of a bench according to one embodiment of the invention.
Figure 5:
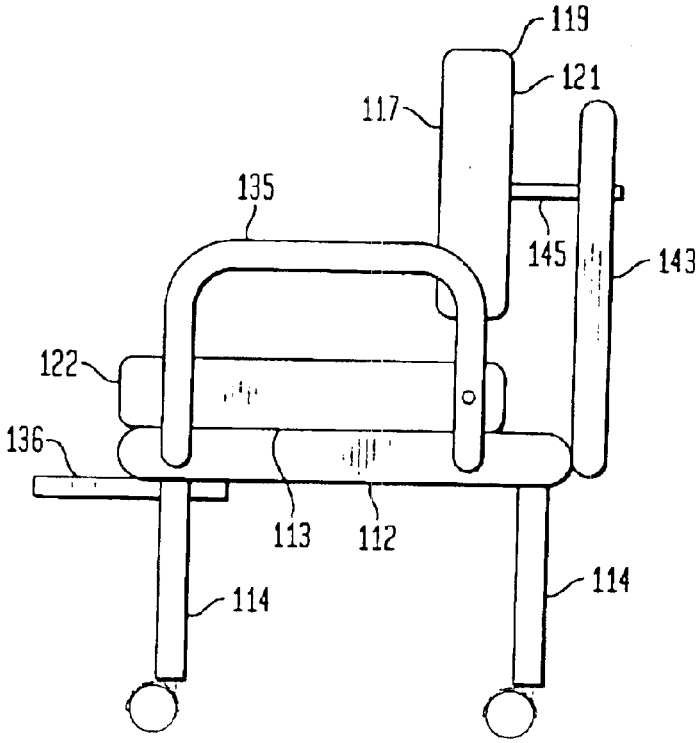
FIG. 5 is a sectional view of the bench taken along line 5—5 in FIG. 4.
Figure 6:
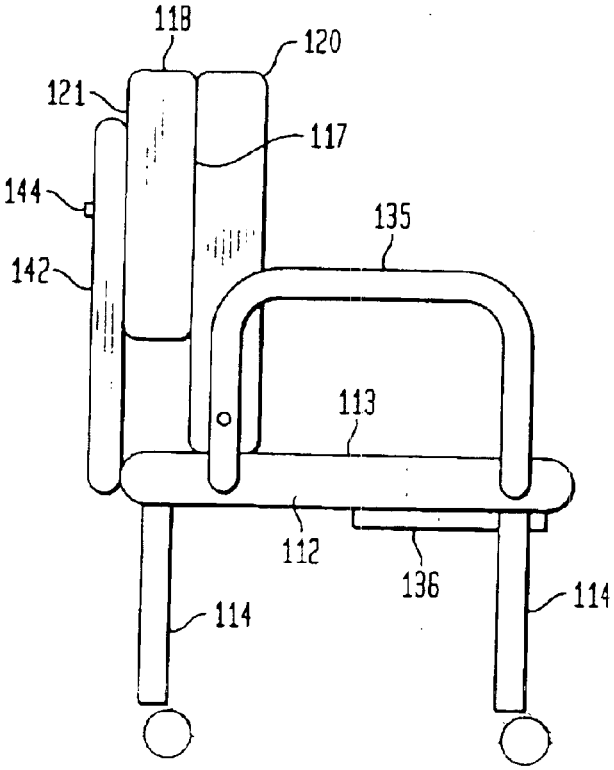
FIG. 6 is a sectional view of the bench taken along line 6—6 in FIG. 4.

FIGS. 4–6 show another embodiment of the invention. The bench 110 comprises a seat 112 having support members 114 extending from the underside 116. The bench 110 further includes first and second substantially vertical backs 118, 119 connected to the seat at first and second seating position 124, 126, respectively. The backs define a first side 117 and a second side 121 and are attached to the seat 112 via first and second connecting members 142, 143 and extendible rods 144, 145. The connecting members 142, 143 extend substantially vertically from the seat 112 and support the extendible rods 144, 145. The extendible rods attach the connecting members 142, 143 to the second sides 121 of the backs 118, 119. The extendible rods 144, 145 allow the backs to be displaced along the horizontal axis.

First and second pivotal members 120, 122 correspond to the first and second seating positions 124, 126, respectively. As shown in FIG. 4, the pivotal members 120, 122 define a bore 146 extending substantially horizontally through a lower end of the pivotal members 120, 122. Rods 148 are positioned in the bores 146. The rods 148 have a diameter smaller than the diameter of the bores 146.

The bench 110 further has arm rests 134 located at opposite ends of the seat and interior arm rests 135 located in between first and second seating positions 124, 126. The arm rests 134, 135 define a recess on its interior side or a hole therethrough, coaxially situated with the bores 146 of the pivotal members 120, 122. The rods 148 rest in the recess or hole of the arm rests 134, 135. Thus, rods 148 allow the pivotal members to pivot between a substantially horizontal position adjacent to a top side 113 of the seat 112 and a substantially vertical position adjacent to the first side 117 of the backs.

A first attachment mechanism 128 is located on each of the pivotal members 120, 122 and a second attachment mechanism 130 is located on the first side 117 of each of the backs 118, 119. In addition, foot rests 136 are slidably mounted to the underside 116 of the seat 112. As illustrated, the bench 110 is positioned to accommodate an adult in the first seating position 124 and a child in the second seating position 126. At the first seating position 124, the first and second attachment mechanism 128, 130 are coupled, therefore pivotal member 120 is in a substantially vertical position. At the second seating position 126 the first and second attachment mechanisms have been uncoupled, allowing the second pivotal member 122 to pivot about the rod 148 to the substantially horizontal position adjacent to the top side 113 of the seat 112. The extendable rod 143 is then expanded to move the second back 119 forward along the horizontal axis over the horizontal pivotal member 122. The foot rest 136 is also slid forward to provide an area for the child to place his or her feet. Thus, the second seating position 126 is arranged to have a seating area with an increased height to accommodate a child comfortably. Moreover, the back 119 provides the child with adequate back support since it is forwardly displaced.

Of course, the present invention contemplates a bench having more than two seating positions. The invention further contemplates a bench wherein all, some or none of the seating positions be arranged to accommodate a child. Thus, the bench of the invention may accommodate only children, only adults, or any combination of children and adults to fill each seating position.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A bench for use by at least two persons comprising:

a substantially horizontal seat including at least two seating portions and having a top side and an underside;

a back extending substantially vertically from said seat and having a first side and a second side;

at least two pivotal members, each said pivotal member corresponding to each said seating portion and having an upper end and a lower end, wherein each said pivotal member pivots between a substantially horizontal position adjacent to said top side of said seat and a substantially vertical position adjacent to said first side of said back;

a support extending from said underside of said seat;

a pair of arm rests each said arm rest being located at an end of said seat;

a plurality of additional arm rests, each said additional arm rest being located on an interior end of each said seating position;

at least two rods, each said rod corresponding to each said seating position, wherein each said pivotal member defines a bore having a slightly greater diameter than said rod and each said arm rest and additional arm rest defines a recess substantially coaxially aliated with said bore, said rod extending through said bore and terminating in said recesses to allow said pivotal members to pivot between the substantially vertical position and the substantially horizontal position.

2. A bench according to claim 1, further comprising at least two pairs of attachment mechanisms, each said pair of attachment mechanisms corresponding to each said seating position, one attachment mechanism of each said pair being located on said first side of said back and the other attachment mechanism of each said pair being located on said pivotal member, wherein when the attachment mechanisms of said pair are coupled, said corresponding pivotal member is in the substantially vertical position adjacent to said first side of said back and when the attachment mechanisms of said pair are uncoupled, said corresponding pivotal member pivots to the substantially horizontal position adjacent to said top side of said seat.

3. A bench according to claim 2, further comprising at least two flip members, each said flip member being attached to said back at a corresponding sealing position and being movable from a position adjacent to said second side of said back to a position adjacent to said first side of said back, when said corresponding pivotal member is in the substantially horizontal position.

4. A bench according to claim 1, further comprising at least two adjustable foot rests, each said foot rest corresponding to each said seating position.

5. A bench according to claim 4, wherein each said foot rest is slidably mounted to said underside of said seat.

6. A bench according to claim 1, further comprising a sheet of material connecting each said pivotal member to said seat, wherein said sheet allows said pivotal members to pivot about between the substantially vertical position and the substantially horizontal position.

7. A bench according to claim 1, wherein said support comprises a plurality of legs extending from the underside of said seat, each said leg having a wheel at an end remote from the underside of said seat.

* * * * *